US007988827B2

(12) United States Patent
Valls et al.

(10) Patent No.: US 7,988,827 B2
(45) Date of Patent: Aug. 2, 2011

(54) EMULSIONS

(75) Inventors: Ramon Valls, Barcelona (ES); Stéphanie Merlet, Boulogne (FR)

(73) Assignee: Cognis IP Management GmbH, Duesseldorf (DE)

( * ) Notice: Subject to any disclaimer, the term of this patent is extended or adjusted under 35 U.S.C. 154(b) by 755 days.

(21) Appl. No.: 12/021,322

(22) Filed: Jan. 29, 2008

(65) Prior Publication Data

US 2008/0185113 A1 Aug. 7, 2008

(30) Foreign Application Priority Data

Jan. 29, 2007 (EP) ..... 07001847

(51) Int. Cl.
*D21H 17/07* (2006.01)
*D21H 17/14* (2006.01)
*D21H 21/02* (2006.01)

(52) U.S. Cl. ..... 162/158; 162/179; 516/69; 516/72

(58) Field of Classification Search ..... 162/158, 162/179; 516/69, 72
See application file for complete search history.

(56) References Cited

U.S. PATENT DOCUMENTS 3,274,050 A * 9/1966 Buckman et al. ..... 162/190
3,428,592 A * 2/1969 Youker ..... 524/591
3,519,377 A * 7/1970 Muro et al. ..... 8/586
3,875,301 A * 4/1975 Windheuser ..... 424/45
4,184,912 A 1/1980 Payton
4,208,301 A * 6/1980 Gammon ..... 516/116
5,176,796 A 1/1993 Irie et al.
5,354,726 A * 10/1994 Narayanan et al. ..... 504/365
5,496,857 A * 3/1996 Targosz ..... 514/617
5,527,431 A 6/1996 Shetty et al.
5,580,567 A * 12/1996 Roberts ..... 424/405
5,681,851 A * 10/1997 Lee et al. ..... 514/547
5,776,494 A * 7/1998 Guskey et al. ..... 424/414
2002/0096293 A1 7/2002 Nguyen et al.
2004/0231816 A1 11/2004 Van de Steeg et al.
2005/0039873 A1 * 2/2005 Curham et al. ..... 162/199
2007/0270612 A1 * 11/2007 Pompeo et al. ..... 564/123

FOREIGN PATENT DOCUMENTS

EP 0569085 11/1993
EP 0 599 440 6/1994
GB 1 053 403 1/1967
WO WO 2005/019527 3/2005

* cited by examiner

*Primary Examiner* — Matthew J Daniels
*Assistant Examiner* — Dennis Cordray
(74) *Attorney, Agent, or Firm* — Diehl Servilla LLC

(57) ABSTRACT

An aqueous emulsion, including (a) a dialkylamide; and (b) a non-ionic surfactant, is provided. An emulsion, including (a) about 30% b.w. to about 70% b.w. of a dialkylamide; (b) about 5% b.w. to about 25% b.w. of a non-ionic surfactant; and (c) 0% b.w. to about 15% b.w. of an anionic surfactant, where the amounts, with water added and optional auxiliary agents, add to 100% b.w., is also provided. A method for reducing pitch in the production of paper includes adding the emulsion to pulp.

19 Claims, No Drawings

EMULSIONS

BACKGROUND OF THE INVENTION

1. Cross-Reference to Related Applications

This application claims priority under 35 U.S.C. §119 from European Patent Application No. 07001847.8, filed Jan. 29, 2007, the entire disclosure of which is hereby incorporated by reference herein.

2. Field of the Invention

The present invention relates generally to emulsions, and more particularly, relates to emulsions used in the production of paper.

3. Background Information

Pitch and stickies are interfering substances in the wet end of paper machines that can affect both machine operation and paper quality. The terms "pitch" or "wood pitch" as used herein refer to a colloidal dispersion of wood-derived hydrophobic particles released from the fibers during a pulping process. Wood pitch includes fatty acids, resin acids, the insoluble salts thereof, and esters of fatty acids with glycerol, sterols, and other fats and waxes. The hydrophobic components of pitch, particularly triglycerides, are considered one of the major factors determining whether the presence of such pitch will lead to deposit problems. Deposit-forming pitch often contains significantly high amounts of triglyciderides. As used herein, "stickies" mean sticky materials and interfering substances that arise from components of recycled fibers, such as adhesives and coatings. Stickies can come from coated broke, recycled waste paper for board making and de-inked pulp (DIP). The stickies from coated broke is sometimes called white pitch. Deposition of pitch and stickies often leads to defects in the finished product, and paper machine downtime, causing lost profits to the mill. These problems become more significant when paper mills "close up" their process water systems for conservation and environmental reasons. Unless the pitch and stickies are continuously removed from the system in a controlled manner, these interfering substances will accumulate and eventually lead to deposition and runnability problems. Technology in place today is based on fixing the pitch or stickies to the fibers before they have a chance to agglomerate, or alternatively, coating the pitch or stickies with a polymer that makes them non-tacky and therefore unable to agglomerate.

Minimizing or preventing the deposit of pitch and stickies in pulp and paper making processes is therefore necessary to minimize equipment fouling and down time, maximizing production efficiency, and improving product quality.

Methods for pitch control include cationic fixation with alum or cationic polymers, dispersion with surfactants, absorption with talc, and chelation of heavy metals. Typically used pitch controls include silicon polyelectrolytes (U.S. Pat. No. 5,527,431), proteins and polymers (U.S. Publication No. 2002/0096293 A1), non-ionic surfactants (International Publication No. WO 2005/019537 A1), and melamine formaldehyde polymers (European Patent Publication No. 0569085 A1). Enzymatic methods also are known. For example, U.S. Pat. No. 5,176,796 (Irie) discloses adding acylglycerol lipase to mechanical pulp paperstock or reused water. Among the various so-called "pitch control" agents, non-ionic surfactants play an important role due to their high biological degradability. Unfortunately, the products do not prevent the formation of agglomerates and their ability to disperse fine particles over a longer time is not always satisfying.

There remains a need for compositions which reduce the formation of pitch and stickies in paper pulp, and an improved pitch control system in the production of paper.

SUMMARY OF THE INVENTION

Briefly described, an aqueous emulsion, including (a) a dialkylamide; and (b) a non-ionic surfactant is provided, according to an aspect of the invention.

According to another aspect of the invention, an emulsion, including (a) about 30% b.w. to about 70% b.w. of a dialkylamide; (b) about 5% b.w. to about 25% b.w. of a non-ionic surfactant; and (c) 0% b.w. to about 15% b.w. of an anionic surfactant, wherein the amounts, with water added and optional auxiliary agents, add to 100% b.w., is also provided.

According to another aspect of the invention, a method for reducing pitch in the production of paper includes adding the emulsion to pulp.

DETAILED DESCRIPTION OF THE INVENTION

The problem underlying the present invention has been to develop an improved pitch control system based on non-ionic surfactants which, on one hand, fulfills the technical requirements with respect to dispersing power and ability to dissolve pitch and stickies, and on the other hand, meets the environmental needs for high biological degradability.

The present invention includes aqueous emulsions, comprising: (a) dialkylamides; and (b) non-ionic surfactants. Surprisingly, it has been observed that emulsions comprising non-ionic surfactants and dialkylamides exhibit an improved ability for reducing the formation of pitch and stickies and also show an improved performance in dispersing these solids over longer storage times and at higher temperatures. At the same time, the emulsions are readily biodegradable and therefore environmentally friendly.

Dialkylamides

According to an aspect of the present invention it has been found that both dialkylamides based on mono and dicarboxylic acids are useful to act as solvents within the proposed pitch control system. Therefore, in a preferred embodiment of the present invention, suitable dialkylamines based on fatty acids follow the general formula (I),

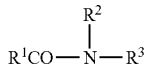

(I)

in which $R^1CO$ represents for an aliphatic or aromatic acyl radical having 6 to 22 carbon atoms, preferably 8 to 12 carbon atoms and 0 or 1 to 3 double bonds, and $R^2$ and $R^3$ independently from each other represent a $C_1$-$C_4$ alkyl radical. Typical examples are dialkylamides based on caproic acid, caprylic acid, 2-ethyl hexanoic acid, caprinic acid, lauric acid, myristic acid, palmitic acid, stearic acid, isostearic acid, oleic acid, (conjugated) linolic acid, linoleic acid, gadoleic acid, arachidonic acid, behenic acid, erucic acid, tall oil fatty acid, and their technical mixtures or benzoic acid. Examples for suitable alkyl groups are methyl, ethyl, propyl, i-propyl, n-butyl, i-butyl, and tert-butyl.

In another embodiment, the dialkylamides can be derived from dicarboxylic acids and follow the general formula (II)

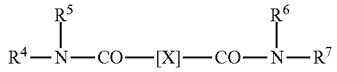

(II)

in which $R^4$, $R^5$, $R^6$ and $R^7$ independently from each other represent a $C_1$-$C_4$ alkyl or hydroxyalkyl radical and X represents an alkylene group having 1 to 12 carbon atoms. Typical examples are the symmetrical or asymmetrical diamides based on maleic acid, fumaric acid or adipic acid. Examples for suitable alkyl groups are methyl, ethyl, propyl, i-propyl, n-butyl, i-butyl, and tert.-butyl. In another preferred embodiment of the present invention, dialkylamides are used which show similar alkyl groups, preferably methyl groups, since dimethylamides exhibit superior solvent properties. Therefore, the residues $R^1$ to $R^7$ in formulae (I) and (II) preferably represent methyl groups.

The species showing the best solvent properties can be found in the group comprising the $C_{16}$-$C_{18}$ fatty acid dimethylamides, such as, for example, stearic acid dimethylamide or tallow fatty acid dimethylamide, which are especially preferred for the purpose of the present invention.

Non-ionic Surfactants

Non-ionic surfactants (Component b) to be added to the preparations as emulsifiers include, for example:

products of the addition of 2 to 30 mol ethylene oxide and/or 0 to 5 mol propylene oxide onto linear $C_{8-22}$ fatty alcohols, onto $C_{12-22}$ fatty acids onto $C_{12-22}$ fatty acid amides and onto alkyl phenols containing 8 to 15 carbon atoms in the alkyl group;

$C_{12-18}$ fatty acid monoesters and diesters of addition products of 1 to 30 mol ethylene oxide onto glycerol;

alk(en)yl oligoglycosides;

glycerol mono- and diesters and sorbitan mono- and diesters of saturated and unsaturated fatty acids containing 6 to 22 carbon atoms and ethylene oxide addition products thereof;

addition products of 15 to 60 mol ethylene oxide onto castor oil and/or hydrogenated castor oil;

polyol esters and, in particular, polyglycerol esters such as, for example, polyglycerol polyricinoleate, polyglycerol poly-12-hydroxystearate or polyglycerol dimerate isostearate. Mixtures of compounds from several of these classes are also suitable;

addition products of 2 to 15 mol ethylene oxide onto castor oil and/or hydrogenated castor oil;

partial esters based on linear, branched, unsaturated or saturated $C_{6-22}$ fatty acids, ricinoleic acid and 12-hydroxystearic acid and glycerol, polyglycerol, pentaerythritol, dipentaerythritol, sugar alcohols (for example, sorbitol), alkyl glucosides (for example, methyl glucoside, butyl glucoside, lauryl glucoside) and polyglucosides (for example, cellulose);

mono-, di- and trialkyl phosphates and mono-, di- and/or tri-PEG-alkyl phosphates and salts thereof;

wool wax alcohols;

polysiloxane/polyalkyl polyether copolymers and corresponding derivatives;

mixed esters of pentaerythritol, fatty acids, citric acid and fatty alcohol and/or mixed esters of $C_{6-22}$ fatty acids, methyl glucose and polyols, preferably glycerol or polyglycerol;

polyalkylene glycols; and glycerol carbonate.

The addition products of ethylene oxide and/or propylene oxide onto fatty alcohols, fatty acids, alkylphenols, glycerol mono- and diesters and sorbitan mono- and diesters of fatty acids or onto castor oil are commercially available products. They are homologue mixtures of which the average degree of alkoxylation corresponds to the ratio between the quantities of ethylene oxide and/or propylene oxide and substrate with which the addition reaction is carried out. $C_{12-18}$ fatty acid monoesters and diesters of addition products of ethylene oxide onto glycerol are used as lipid layer enhancers for cosmetic formulations. The preferred emulsifiers are described in more detail as follows:

Fatty Alcohol Alkoxylates

A first group of preferred non-ionic surfactants encompasses fatty alcohol alkoxylates, and particularly the fatty alcohol ethoxylates preferably corresponding to formula (III):

$$R^8O(CH_2CH_2O)_nH \quad \text{(III)}$$

in which $R^8$ is a linear or branched alkyl and/or alkenyl group containing 12 to 24 carbon atoms, and more particularly, 16 to 22 carbon atoms, and n is a number from 1 to 30, and more particularly from 10 to 20. Typical examples are products of the addition of on average 10 to 20 moles of ethylene oxide onto cetyl alcohol, stearyl alcohol, isostearyl alcohol, cetearyl alcohol and behenyl alcohol.

Partial Glycerides

A second group of preferred non-ionic surfactants is represented by partial glycerides, i.e., monoglycerides, diglycerides and technical mixtures thereof, which may still contain small quantities of triglycerides from their production, and generally correspond to formula (IV):

$$\begin{array}{l} CH_2O(CH_2CH_2O)_mCOR^9 \\ | \\ CHO(CH_2CH_2O)_pR^{10} \\ | \\ CH_2O(CH_2CH_2O)_qR^{11} \end{array} \quad \text{(IV)}$$

in which $R^9CO$ is a linear or branched, saturated and/or unsaturated acyl group containing 6 to 22 carbon atoms and, preferably, 12 to 18 carbon atoms, $R^{10}$ and $R^{11}$ independently of one another have the same-meaning as $R^9CO$ or represent OH, and the sum (m+p+q) is 0 or a number between 1 and 100, and preferably between 5 and 25, with the proviso that at least one of the two substituents $R^{10}$ and $R^{11}$ represents OH. Typical examples are mono- and/or diglycerides based on caproic acid, caprylic acid, 2-ethylhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof. Technical lauric acid glycerides, palmitic acid glycerides, stearic acid glycerides, isostearic acid glycerides, oleic acid glycerides, behenic acid glycerides and/or erucic acid glycerides, which have a monoglyceride content of 50 to 95% by weight, and preferably, 60 to 90% by weight, are preferably used.

Alk(en)yl Oligoglycosides

Another group of preferred non-ionic emulsifiers are the alkyl polyglycosides which can be used in the compositions according to the invention. The compounds may be derived from aldoses or ketoses containing 5 or 6 carbon atoms, preferably glucose. Accordingly, the preferred alkyl and/or alkenyl oligoglycosides are alkyl or alkenyl oligoglucosides, also known as "alkyl polyglycosides" (APG). The alk(en)yl oligoglycosides according to the invention correspond to formula (V):

$$R^{12}O[G]_p \quad \text{(V)}$$

wherein $R^{12}$ is an alkyl or alkenyl radical having from 6 to 22 carbon atoms, G is a sugar unit having 5 or 6 carbon atoms, and p is a number from 1 to 10. The index p in general formula (V) indicates the degree of oligomerisation (DP degree), i.e., the distribution of mono- and oligoglycosides, and is a number from 1 to 10. Whereas p in a given compound must always be an integer and, above all, may assume a value from 1 to 6, the value p for a certain alkyl oligoglycoside is an analytically determined, calculated quantity which is mostly a fraction number. Alk(en)yl oligoglycosides having an average degree of oligomerization p of 1.1 to 3.0 are preferably used. Alk(en)yl oligoglycosides having a degree of oligomerization below 1.7 and, more particularly, between 1.2 and 1.4 are preferred. The alkyl or alkenyl radical $R^{12}$ may be derived from primary alcohols containing 4 to 22 carbon atoms, and preferably 8 to 16 carbon atoms. Typical examples are butanol, caproic alcohol, caprylic alcohol, capric alcohol, undecyl alcohol, lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and technical mixtures thereof such as are formed, for example, in the hydrogenation of technical fatty acid methyl esters or in the hydrogenation of aldehydes from Roelen's oxo synthesis. Alkyl oligoglucosides based on hydrogenated $C_8$-$C_{16}$ coconut oil alcohol having a DP of 1 to 3 are preferred.

Fatty Acid Amide Alkoxylates

Another preferred group of non-ionic emulsifiers encompasses adducts of alkylene oxides to fatty acid amides, preferably fatty acid amide ethoxylates, which follow general formula (VI), $$R^{13}CO—NH(CH_2CHR^{14}O)_pH \quad (VI)$$

in which $R^{13}CO$ represents a saturated or unsaturated acyl radical having 8 to 22 carbon atoms, preferably 12 to 18 carbon atoms, and 0 or 1 to 3 double bonds, $R^{14}$ represents for hydrogen or methyl, and p represents an integer from 1 to 20, preferably 5 to 10. Typical examples are adducts of on average 1 to 20, and preferably 5 to 10 mol, ethylene and/or propylene oxide to coco fatty acid amide or tallow fatty acid amide.

Sorbitan Esters

Sorbitan esters form another group of preferred non-ionic surfactants. Examples of suitable esters include sorbitan monoisostearate, sorbitan sesquiisostearate, sorbitan diisostearate, sorbitan triisostearate, sorbitan monooleate, is sorbitan sesquioleate, sorbitan dioleate, sorbitan trioleate, sorbitan monoerucate, sorbitan sesquierucate, sorbitan dierucate, sorbitan trierucate, sorbitan monoricinoleate, sorbitan sesquiricinoleate, sorbitan diricinoleate, sorbitan triricinoleate, sorbitan monohydroxystearate, sorbitan sesquihydroxystearate, sorbitan dihydroxystearate, sorbitan trihydroxystearate, sorbitan monotartrate, sorbitan sesquitartrate, sorbitan ditartrate, sorbitan tritartrate, sorbitan monocitrate, sorbitan sesquicitrate, sorbitan dicitrate, sorbitan tricitrate, sorbitan monomaleate, sorbitan sesquimaleate, sorbitan dimaleate, sorbitan trimaleate and technical mixtures thereof. Addition products of 1 to 30 mol, and preferably 5 to 10 mol, ethylene oxide onto the sorbitan esters mentioned are also suitable.

Polyglycerol Esters

Another group of preferred non-ionic surfactants encompasses polyglycerol esters. Suitable examples include Polyglyceryl-2 Dipolyhydroxystearate (Dehymuls® PGPH), Polyglycerin-3-Diisostearate (Lameform® TGI), Polyglyceryl-4 Isostearate (Isolan® GI 34), Polyglyceryl-3 Oleate, Diisostearoyl Polyglyceryl-3 Diisostearate (Isolan® PDI), Polyglyceryl-3 Methylglucose Distearate (Tego Care® 450), Polyglyceryl-3 Beeswax (Cera Bellina®), Polyglyceryl-4 Caprate (Polyglycerol Caprate T2010/90), Polyglyceryl-3 Cetyl Ether (Chimexane® NL), Polyglyceryl-3 Distearate (Cremophor® GS 32) and Polyglyceryl Polyricinoleate (Admul® WOL 1403), Polyglyceryl Dimerate Isostearate and mixtures thereof. Other suitable polyolesters include the mono-, di- and triesters of trimethylol propane or pentaerythritol with lauric acid, cocofatty acid, tallow fatty acid, palmitic acid, stearic acid, oleic acid, behenic acid and the like, optionally reacted with 1 to 30 mol ethylene oxide.

In a preferred embodiment of the present invention, the non-ionic surfactant represents a mixture, in particular, of:

(i) fatty alcohol alkoxylates and partial glycerides, or (ii) partial glycerides and alk(en)yl oligoglycosides, or (iii) fatty acid amide alkoxylates and alk(en)yl oligoglycosides.

The ratio in which the two non-ionic surfactants are present may vary from 90:10 to 10:90, preferably from 75:25 to 25:75, and more preferably from 60:40 to 40:60 parts by weight.

Anionic Co-surfactants

In another preferred embodiment, the emulsions according to the present invention may include also anionic surfactants as coemulsifiers. Typical examples are aliphatic $C_{12-22}$ fatty acids, such as palmitic acid, stearic acid or behenic acid, for example, and $C_{12-22}$ dicarboxylic acids, such as azelaic acid or sebacic acid, for example, or (alkyl) aryl sulfonates in the form of their alkaline or alkaline-earth salts. A preferred concentrated composition exhibiting self-emulsifying properties consists, for example, of the following components: dialkylamides; fatty acid amide ethoxylates; alkyl polyglucosides; and alkyl aryl sulfonates.

Emulsions

In a further preferred embodiment of the present invention, the emulsion comprises:

(a) about 30% b.w. to about 70% b.w., preferably about 40% b.w. to about 60% b.w., and more preferably about 45% b.w. to about 55% b.w. dialkylamides;

(b) about 5% b.w. to about 25% b.w., preferably about 10% b.w. to about 20% b.w. non-ionic surfactants; and (c) 0% b.w. to about 15% b.w., preferably about 5% b.w. to about 15% b.w. anionic surfactants, wherein the amounts, with the addition of water and optionally further auxiliary agents, add to 100% b.w. The water content of the emulsions according to the invention may vary between 30% and 90% b.w., and more particularly between 40% and 60% b.w.

It has been found very advantageous to use the emulsions comprising very finely dispersed droplets. Thus it is preferred to use PIT emulsions, microemulsions or self-emulsifying concentrates. Preferred droplet sizes are between 0.01 and 1 μm, and more preferably, between 0.1 and 0.5 μm. The nature of the emulsions, which are obtainable by standard procedures known to the skilled person, are supported by the type of emulsifiers. For example, mixture (i) cited above is useful for making PIT emulsions, while mixture (ii) is more advantageous for the production of micro-emulsions. Finally, mixture (iii) is usually applied for making self-emulsifying concentrates, which are concentrates that form an emulsion without additional introduction of mechanical energy (e.g., stirring).

INDUSTRIAL APPLICATION

The emulsions according to the present invention have been found useful for reducing the formation of pitch and stickies in paper pulp and dispersing the remaining solids during the manufacture of paper. A further aspect of the present invention is therefore directed to the use of the emulsions as pitch-control systems for the manufacture of paper.

EXAMPLES

Pitch Dispersion Test

The pitch dispersion test was conducted with a suspension of 0.5% b.w. consistency of bleached hardwood pulp. In the suspension, synthetic pitch was added (sodium soap of tall oil) in an amount of 3% based on dry pulp. To this "contaminated" fiber suspension (1 kg of suspension) the inventive emulsions 1 to 3 and the comparative products C1 and C2 were added in a fixed dosage. The mixtures thus obtained were agitated for 30 min, and mechanical shearing forced the pitch to the walls of the steel beaker. After mixing, the content of the bake was removed and the pitch present on the walls of the beaker was extracted with ethyl alcohol. After eliminating the alcohol from the extract, the amount of pitch was determined by weighting. In this process, the following rule applies: the less weight there is, the more effective is the control of the pitch additive.

Examples 1 to 5, and Comparative Examples C1 and C2

Example 1 was prepared according to the invention by the PIT method, the inventive Examples 2 to 5 were prepared by mixing of the dialkylamides with emulsifiers and/or dispersing agents. Comparative Example C1 used the dialkylamides alone, instead of as a component of an emulsion, and Comparative Example C2 used the emulsifier alone. For making the PIT emulsions, dialkylamides, non-ionic emulsifiers and half a part of water were mixed and heated until boiling, until the phase inversion temperature (about 95° C.) was reached. Subsequently, the emulsions were cooled while the remaining part of cold water was added (which may include a cationic co-emulsifier). The final emulsions were cooled to room temperature. Table 1 shows the composition of the tested emulsions. All amounts were calculated as weight percent.

TABLE 1

| Pitch control tests | | | | | | | |
|---|---|---|---|---|---|---|---|
| Composition/Properties | 1 | 2 | 3 | 4 | 5 | C1 | C2 |
| Tallow fatty acid dimethylamide | 30 | 35 | 70 | 60 | 30 | 100 | |
| $C_{12-18}$ Fatty alcohol + 5EO | 10 | — | — | — | — | — | — |
| Oleic acid monoglyceride | 2 | — | — | — | — | — | 100 |
| $C_{12-18}$ fatty acid amide + 4EO | — | 4 | — | 7 | 5 | — | — |
| $C_{8/10}$ Alkylpolyglucoside | — | 15 | 15 | 15 | — | — | — |
| Sodium Dodecylsulfonate | — | — | — | — | 15 | — | — |
| Water | | | add to 100 | | | | |
| Droplet size, stability and viscosity | | | | | | | |
| Droplet size D(50) [microns] | 0.15 | 4 | 8 | nd | Nd | nd | nd |
| Droplet size D(90) [microns] | 0.30 | 11 | 25 | nd | Nd | nd | nd |
| Stability[1] after 1 week | +++ | +++ | +++ | nd | Nd | nd | nd |
| Stability after 4 weeks | +++ | +++ | +++ | nd | Nd | nd | nd |
| Stability at 1% b.w. dilution | +++ | +++ | +++ | nd | Nd | nd | nd |
| Viscosity[2] [mPas] | 300 | 350 | 420 | nd | Nd | nd | nd |
| Pitch control | | | | | | | |
| Active dosage [ppm] | 50 | 50 | 50 | 50 | 50 | 50 | 50 |
| Pitch deposition [mg][3] | 13 | 11 | 12 | 11 | 12 | 43 | 61 |

[1](+++) no sedimentation, (++) sedimentation <1%, (+) sedimentation <3%, (–) sedimentation <5%, (—) sedimentation >5%;
[2]Brookfield RVT, 20° C., 10 rpm, Spindle 1;
[3]Compared to blank (115 mg) – nd = not determined

What is claimed is:

1. An aqueous emulsion, comprising:

(a) one or more dialkylamides; and (b) a mixture of non-ionic surfactants selected from:

(i) a mixture of fatty alcohol alkoxylates and partial glycerides, or (ii) a mixture of partial glycerides and alk(en)yl oligoglycosides, or (iii) a mixture of fatty acid amide alkoxylates and alk(en)yl oligoglycosides.

2. The emulsion according to claim 1, wherein component (a) comprises a dialkylamide according to formula (I):

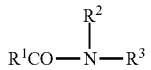

(I)

wherein $R^1CO$ represents an aliphatic or aromatic acyl group having 6 to 22 carbon atoms, and 0 or 1 to 3 double bonds, and $R^2$ and $R^3$ independently represent a $C_1$-$C_4$ alkyl group.

3. The emulsion according to claim 1, wherein component (a) comprises a dialkylamide according to formula (I):

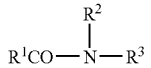

(I)

wherein $R^1CO$ represents an aliphatic or aromatic acyl group having 8 to 12 carbon atoms, and 0 or 1 to 3 double bonds, and $R^2$ and $R^3$ independently represent a $C_1$-$C_4$ alkyl group.

4. The emulsion according to claim 1, wherein component (a) comprises a dialkylamide according to formula (II):

(II)

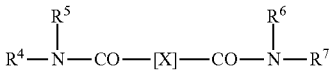

wherein $R^4$, $R^5$, $R^6$ and $R^7$ independently represent a $C_1$-$C_4$ alkyl or hydroxyalkyl group, and X represents an alkylene group having 1 to 12 carbon atoms.

5. The emulsion according to claim 2, wherein component (a) further comprises a dialkylamide according to formula (II):

(II)

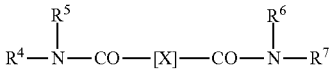

wherein $R^4$, $R^5$, $R^6$ and $R^7$ independently represent a $C_1$-$C_4$ alkyl or hydroxyalkyl group, and X represents an alkylene group having 1 to 12 carbon atoms.

6. The emulsion according to claim 1, wherein component (a) comprises stearic acid dimethylamide.

7. The emulsion according to claim 1, wherein component (a) comprises tallow fatty acid dimethylamide.

8. The emulsion according to claim 1, further comprising (c) one or more anionic surfactants.

9. The emulsion of claim 8, comprising:

(a) about 30% to about 70% by weight based on the emulsion, of one or more dialkylamides;

(b) about 5% to about 25% by weight based on the emulsion, of a non-ionic surfactant mixture; and (c) 0% to about 15% by weight based on the emulsion, of one or more anionic surfactants, wherein the amounts, together with water and optional auxiliary agents, add up to 100%.

10. The emulsion according to claim 9, wherein component (a) comprises about 40% to about 60% by weight based on the emulsion, of one or more dialkylamides; component (b) comprises about 10% to about 20% by weight based on the emulsion, of a non-ionic surfactant mixture; and component (c) comprises about 5% to about 15% by weight based on the emulsion, of one or more anionic surfactants.

11. The emulsion according to claim 9, wherein component (a) comprises about 45% to about 55% by weight based on the emulsion, of one or more dialkylamides.

12. The emulsion according to claim 9, wherein component (a) comprises a dialkylamide according to formula (I):

(I)

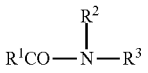

wherein $R^1CO$ represents an aliphatic or aromatic acyl group having 6 to 22 carbon atoms, and 0 or 1 to 3 double bonds, and $R^2$ and $R^3$ independently represent a $C_1$-$C_4$ alkyl group.

13. A method for reducing pitch in the production of paper, comprising the step of adding, to pulp, an emulsion according to claim 1.

14. A method for reducing pitch in the production of paper, comprising the step of adding, to pulp, an emulsion of claim 9.

15. An aqueous emulsion, comprising:

(a) about 30% to about 70% by weight based on the emulsion, of one or more dialkylamides;

(b) about 5% to about 25% by weight based on the emulsion, of one or more non-ionic surfactants; and (c) 0% to about 15% by weight based on the emulsion, of one or more anionic surfactants, wherein the amounts, together with water and optional auxiliary agents, add up to 100%, and wherein component (a) comprises a dialkylamide according to formula (II):

(II)

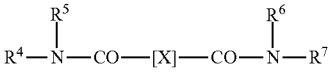

wherein $R^4$, $R^5$, $R^6$ and $R^7$ independently represent a $C_1$-$C_4$ alkyl or hydroxyalkyl group, and X represents an alkylene group having 1 to 12 carbon atoms.

16. The emulsion according to claim 15, wherein component (b) comprises a non-ionic surfactant selected from the group consisting of addition products of 2 to 30 mol ethylene oxide and/or 0 to 5 mol propylene oxide onto linear $C_{8-22}$ fatty alcohols, $C_{12-22}$ fatty acids, $C_{12-22}$ fatty acid amides, and alkyl phenols containing 8 to 15 carbon atoms in the alkyl group; $C_{12-18}$ fatty acid monoesters and diesters of addition products of 1 to 30 mol ethylene oxide onto glycerol; alk(en)yl oligoglycosides; glycerol mono- and diesters and sorbitan mono- and diesters of saturated and unsaturated fatty acids containing 6 to 22 carbon atoms and ethylene oxide addition products thereof; addition products of 15 to 60 mol ethylene oxide onto castor oil and/or hydrogenated castor oil;

polyol esters; addition products of 2 to 15 mol ethylene oxide onto castor oil and/or hydrogenated castor oil; partial esters based on linear, branched, unsaturated or saturated $C_{6-22}$ fatty acids, ricinoleic acid and 12-hydroxystearic acid and glycerol, polyglycerol, pentaerythritol, dipentaerythritol, sugar alcohols, alkyl glucosides and polyglucosides; mono-, di and trialkyl phosphates and mono-, di- and/or tri-PEG-alkyl phosphates and salts thereof; wool wax alcohols; polysiloxane/polyalkyl polyether copolymers and corresponding derivatives; mixed esters of pentaerythritol, fatty acids, citric acid and fatty alcohol, and/or mixed esters of $C_{6-22}$ fatty acids, methyl glucose and polyols; polyalkylene glycols; and glycerol carbonate.

17. A method for reducing pitch in the production of paper, comprising the step of adding, to pulp, an emulsion of claim 15.

18. An emulsion, comprising:

(a) about 30% to about 70% by weight based on the emulsion, of one or more dialkylamides;

(b) about 5% to about 25% by weight based on the emulsion, of one or more non-ionic surfactants; and (c) 0% to about 15% by weight based on the emulsion, of one or more anionic surfactants, wherein the amounts, together with water and optional auxiliary agents, add up to 100%, and wherein component (b) comprises a mixture selected from the group consisting of (i) a mixture of fatty alcohol alkoxylates and partial glycerides; (ii) a mixture of partial glycerides and alk(en)yl oligoglycosides; and (iii) a mixture of fatty acid amide alkoxylates and alk(en)yl oligoglycosides.

19. A method for reducing pitch in the production of paper, comprising the step of adding, to pulp, an emulsion of claim 18.

* * * * *